United States Patent [19]

Stone

[11] Patent Number: 4,549,721

[45] Date of Patent: Oct. 29, 1985

[54] PORTABLE JACK FOR SMALL TRACTORS AND LIKE VEHICLES

[76] Inventor: Kenton A. Stone, 5034 N. 5th St., Arlington, Va. 22203

[21] Appl. No.: 707,035

[22] Filed: Mar. 1, 1985

[51] Int. Cl.[4] ..... B66F 3/22

[52] U.S. Cl. ..... 254/126

[58] Field of Search ..... 254/126, 124, 122, 8 R, 254/8 B, 8 C, 133, 134

[56] References Cited

U.S. PATENT DOCUMENTS

| | | | |
|---|---|---|---|
| 3,451,655 | 6/1969 | Scott | 254/126 |
| 3,741,524 | 6/1973 | Morgan et al. | 254/122 |
| 3,892,132 | 1/1975 | Coton | 254/126 |
| 4,314,691 | 2/1982 | Sato | 254/126 |

*Primary Examiner*—Robert C. Watson

*Attorney, Agent, or Firm*—William J. Daniel

[57] ABSTRACT

In the jack of the invention a chassis member of a small garden tractor, riding lawn mower or like vehicle is engaged by the free ends of a transversely spaced apart set of lifter arms pivoted at their opposite ends on the upper end of an upstanding end stand carried adjacent one end of a base frame of a sufficient longitudinal span to inhibit tilting upon the application of a load to the ends of the lifter arms. Lifting force is applied to the lifter arms by an upwardly extending screw actuated scissors jack seated at its lower end on the base frame and pivotally connected at its upper end to a lifter bar bridging between the lifter arms inwardly of their free ends through a pivotable connecting link forming with the scissors jack an expandable toggle linkage. The end of each lifter arm is preferably longitudinally bifurcated and an adapter is preferably supplied therefor for engagement with different configurations of chassis members, the adapter being so designed as to be wedged in place on the lifter arm end by the weight of the load being lifted.

18 Claims, 6 Drawing Figures

FIG. 2.
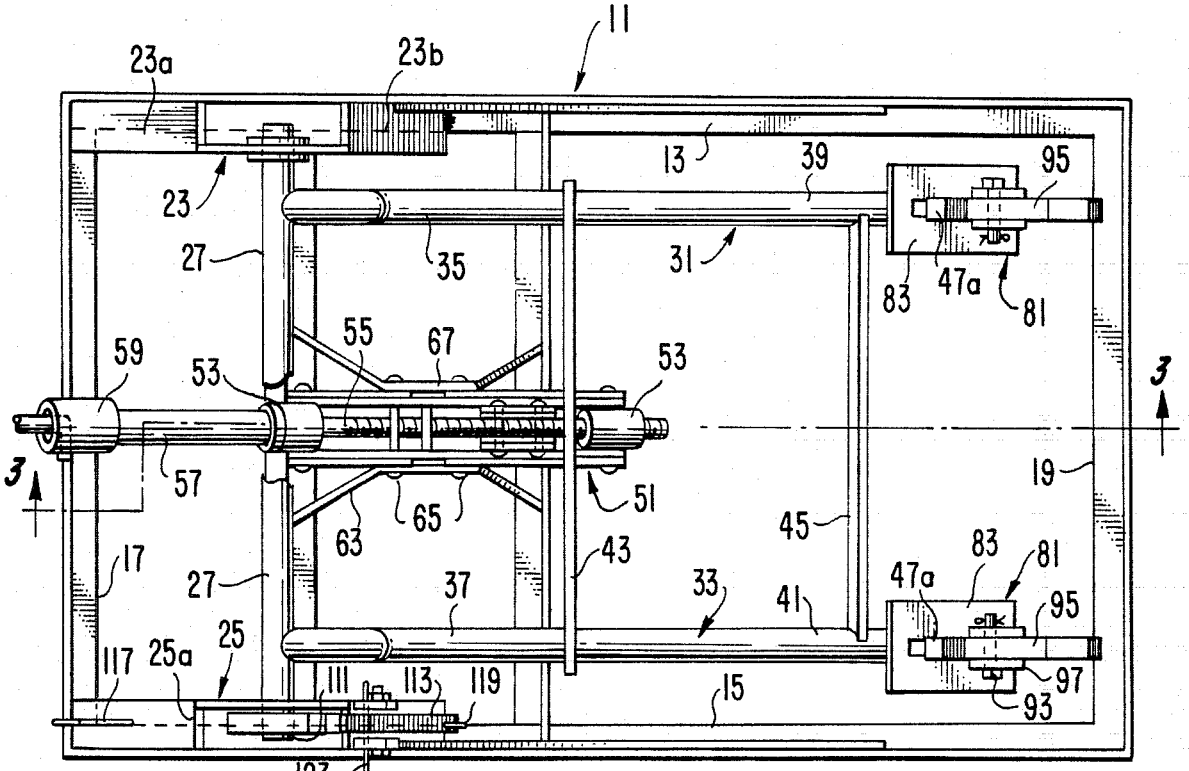
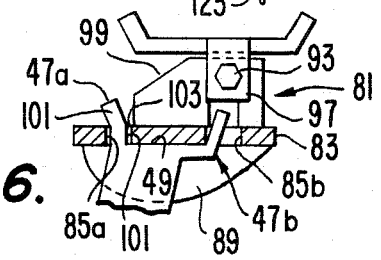
FIG. 6.
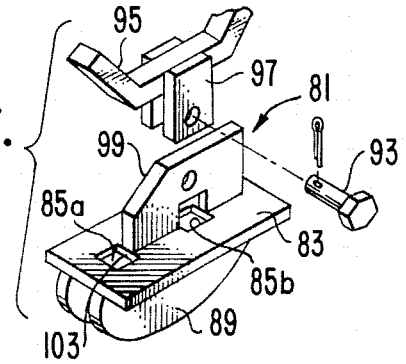
FIG. 5.
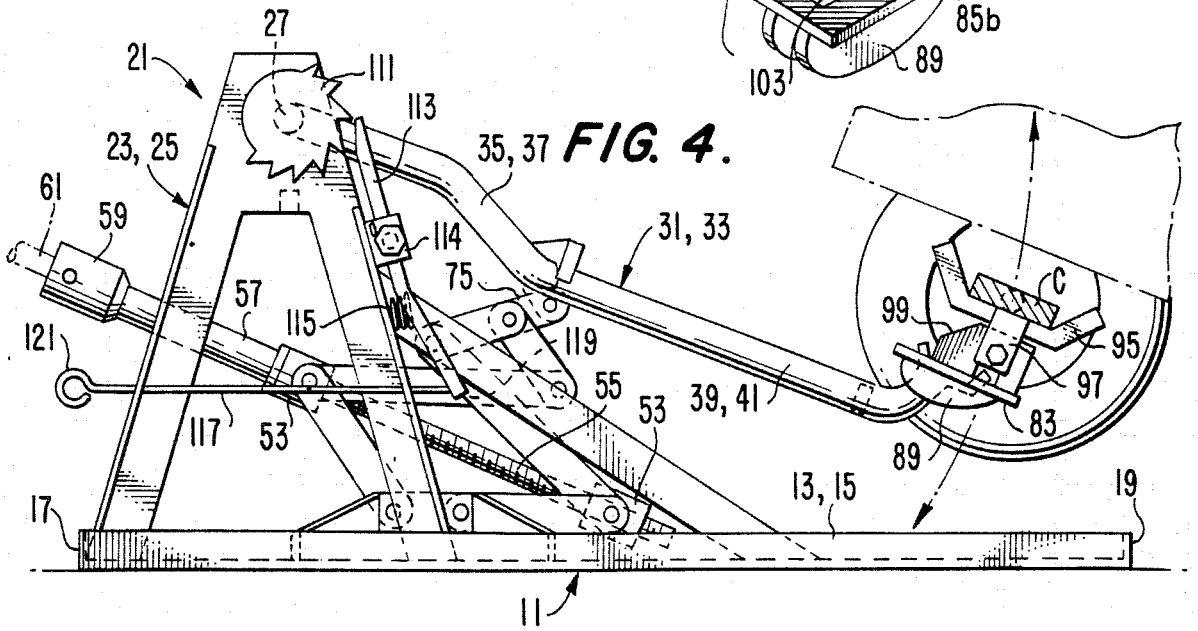
FIG. 4.

PORTABLE JACK FOR SMALL TRACTORS AND LIKE VEHICLES

FIELD OF THE INVENTION

This invention relates to a simple, inexpensive and readily portable jack for engaging and lifting a chassis member of a small lawn or garden tractor or like vehicle to provide access to the undercarriage of said vehicle.

BACKGROUND OF THE INVENTION

In recent years, small tractors, riding lawn mowers and similar vehicles, having a power capacity in the order of roughly 5 to 25 hp have been widely sold for such purposes as the cutting of lawns, tilling the soil, plowing snow, hauling and other tasks around the home or farm. Like all mechanical equipment, these vehicles require servicing such as the removal of rotary blades for sharpening or replacement, periodic lubrication and/or oil changes, etc. It is oft times inconvenient and always expensive to have such maintenance performed at a central service facility having the necessary lifts to elevate the vehicle bodily for performing these operations since the vehicle must be loaded onto some type of carrier and transported to that facility, and delays in the completion of such servicing are common. Many of these servicing operations are of the type that can be performed by the average owner and indeed many owners would prefer to do this work themselves in order to save time and money and, moreover, insure themselves of satisfactory execution.

However, many maintenance procedures require that at least one end of the tractor be elevated at least about one foot and often somewhat higher above the ground so that the operator can have access to the undercarriage of the vehicle where the mower blade is often situated or the lubrication fittings located. Despite their relatively small size and capacity, these vehicles nevertheless have a considerable weight which typically exceeds the lifting strength of the average person. Of course, conventional jacks of the type used for jacking automobiles and the like could be employed, but as is well known by those familiar with automotive mechanics, these jacks are not sufficiently stable in operation to permit work to be safely performed beneath the vehicle suspended therefrom but must be used together with jack stands; but since each side of an end of the tractor must be jacked separately and then placed on a separate jack stand for stable elevation, this is inconvenient and time consuming.

Various kinds of portable jacks have been suggested for various purposes, such as those disclosed in U.S. Pat. Nos. 1,377,147; 1,949,718; 1,949,719; 1,956,797; 2,789,706; 2,814,394; 3,091,431; 3,195,860 and 4,180,252, but none of these are well suited for the function described above.

OBJECTS OF THE INVENTION

The object of the present invention is a simple inexpensively constructed lift or jack designed to engage the chassis member at one end of a small tractor of the type used for gardens, lawns and like vehicles at transversely spaced apart points and to lift the chassis member and with it the corresponding end of the vehicle safely and stably a sufficient distance above the floor or ground as to permit ready access to the undercarriage thereof for performing any of the usual maintenance operations called for.

A further object of the invention is a jack having an adapter capable of accommodating varying configurations of chassis members provided on such vehicles.

Another object of the invention is the provision of an adapter for such jacks that during operation is wedgingly secured in position by the application of the load being lifted so that the weight of the load opposes accidental removal.

These and other objects of the invention will be understood more fully from a reading of the following detailed description of an illustrative embodiment of the jack of the present invention when read in conjunction with the accompanying drawings.

BRIEF DESCRIPTION OF THE DRAWINGS

FIG. 2 is a top plan view of the jack of FIG. 1;

FIG. 4 is a right side elevation of the jack of FIG. 1;

FIG. 5 is an exploded detail view of the adapter; and

FIG. 6 is a detail cross-sectional view through the adapter while in operative position upon the lifter arm and showing its wedging engagement therewith.

DETAILED DESCRIPTION OF THE INVENTION

Figure 1:
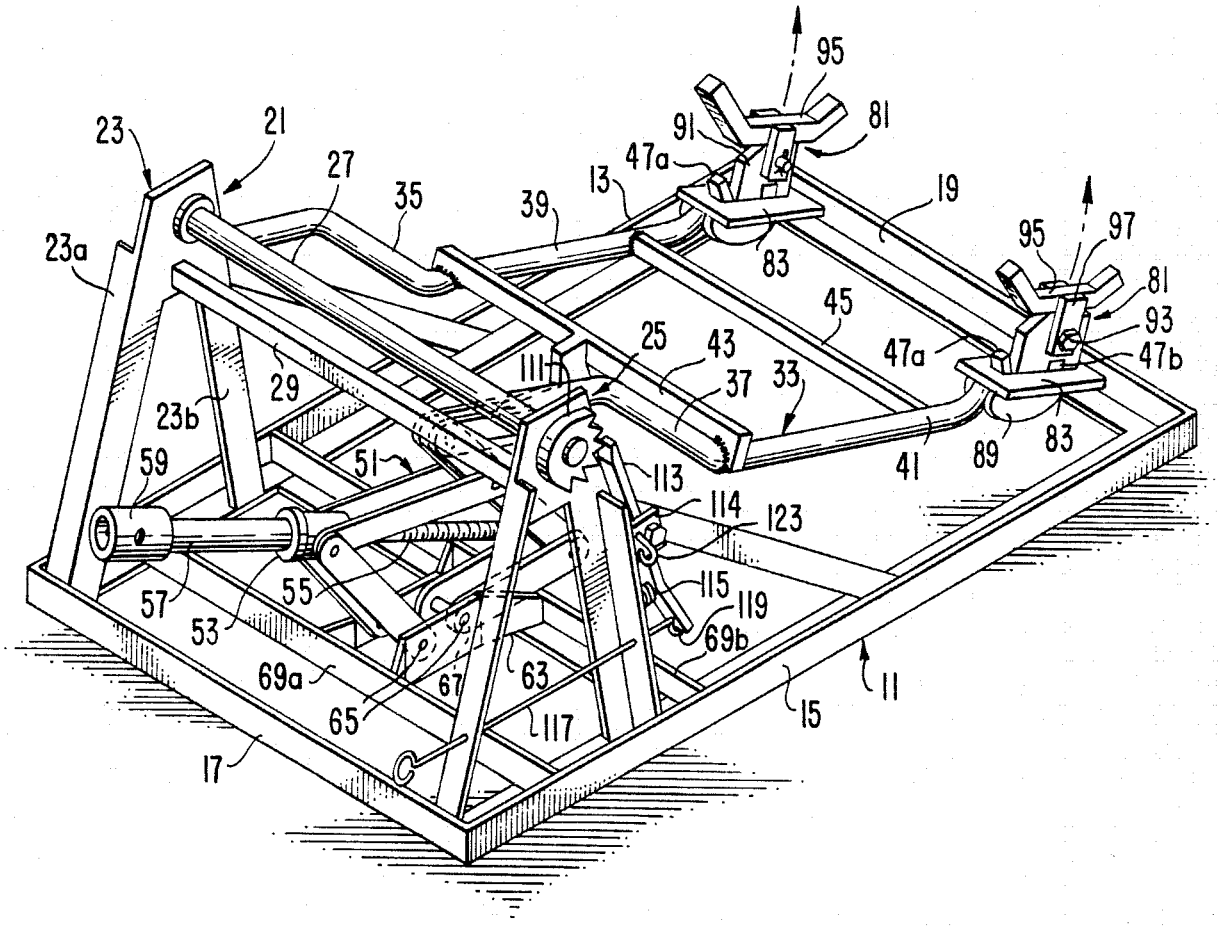
FIG. 1 is a perspective view of a jack according to the present invention.

Referring now to FIG. 1 of the drawings, the jack of the present invention includes a base frame generally designated 11 which as illustrated includes longitudinal side frame members 13 and 15 and end frame members 17 and 19 assembled, e.g., by welding or the like, into a rectangular configuration having a lengthwise dimension substantially greater than its widthwise dimension. The frame members can be constructed of angle iron as suggested in the drawings, and other configurations than rectangular are equally possible provided that the same length to width proportions as indicated above are maintained.

Adjacent one end of base frame 11 is an end stand generally designated 21 consisting of two frame sides 23 and 25 which are upstanding from the plane of the base frame and are braced apart by suitable bracing members into a rigid arrangement. The bracing members include a fulcrum bar 27 extending between the stand sides 23, 25, the upper end of end stand 21 and preferably one or more additional transversely extending beams 29 to adequately support the frame sides. The frame sides can each consist of two legs 23*a*, 23*b*; 25*a*, 25*b* joined at the top in the shape generally or a triangle, being again constructed of angle iron or the like, with the fulcrum bar extending transversely between the tops of these triangles.

Fulcrum bar 27 supports the pivot end of a pair of transversely spaced apart lifter arms 31, 33 and preferably lifter bar 27 is journaled in frame sides 23, 25 for rocking movement relative thereto with the inner ends of lifter arms 31, 33 integrally connected thereto at points near the journaled ends of bar 27. However, bar 27 could, if desired, be fixed to the frame sides and the near ends of arms 31, 33 pivotally mounted thereon.

Lifter arms 31, 33 project from end stand 21 toward the opposite end of base frame 11 and are of a length sufficiently less than the longitudinal dimension of base frame 11 that the base frame provides a stable supporting platform against tilting of the end frame when a load is applied vertically downwardly against the ends of the lifter arms. While specific dimensions may naturally vary, stable operation has been achieved where the base frame is at least about 50% longer than the longitudinal length of lifter arms 31, 33. The section of lifter arms adjacent fulcrum bar 27 is bent into a downwardly directed dogleg as at 35, 37 with the remaining section 39, 41 extending generally straight but offset downwardly. The purpose of this offset is to displace the operative end of the lifter arm array vertically downwardly from the elevated pivot axis of fulcrum bar 27 and thus allow the ends of the arms to pass more readily beneath the chassis member of the vehicle being jacked. The pair of lifter arms 31, 33 are transversely braced along their length into a rigid array by suitable bracing bars, and one of such bracing bars serves as a lifter bar 43 for applying lifting force to the lifter arms. Lifter bar 43 may conveniently be located at the lower end of the dogleg section 35, 37, thereby providing considerable mechanical advantage for the lifting of the arms, and preferably additional bracing bars, such as 45, are situated along the length of the lifter arms, particularly adjacent their free ends. The free ends of these arms are configured for engagement with the chassis member of the vehicle to be elevated and preferably are each longitudinally bifurcated into two upstanding fingers 47*a*, 47*b* with a generally flat supporting surface 49 intermediate the fingers (see FIGS. 3, 4 and 6).

The force for elevating lifter arms 31, 33 is applied to lifter bar 43 by means of screw-actuated scissors or lazy-tongs array of pivotally connected levers generally designated 51 and arranged in the usual configuration with pivot pins passing through the several pivotal axes. Preferably, the array is duplicated in parallel to form a duplex unit held by the pins. Threaded bushings 53 are mounted on two oppositely situated pivot pins of the duplex arrays with a common threaded shaft 55 passing therethrough so that rotation of shaft 55 brings the bushings and the pivot axes associated therewith closer together or further apart, dependent upon the direction of rotation, and thus expands or retracts the length of the duplex arrays. Shaft 55 is extended exteriorly of the scissors array as at 57 and the extension terminates in a keyed socket 59 is adapted to removably receive the hooked end of an operating handle 61 indicated in dotted lines in FIG. 4.

Scissors array 51 is capable of limited swinging movement about a transverse axis, being pivotally connected at its lower end to a floor plate 63 by means of pivot pins 65 passing through ears 67 upstanding from plate 63 for that purpose. Floor plate 63 can be made as an integral part of base frame 11 but preferably, it can be removed therefrom and sits between transverse longitudinally spaced apart beams 69*a, b* welded or otherwise joined to side frames 13, 15 of base frame 11 and providing additional bracing for that frame. Thus, foot plate 63 can bridge between the beams 69*a, b* resting at its ends on the inwardly directed flanges of the latter and fastened to the vertical legs of these beams by means of retaining pins 71*a, b* if it is desired to restrain the base of the scissors array 51 against relative lateral movement.

The base of scissors array 51 is located along base frame 11 at a point spaced from end stand 21 but somewhat closer to that end than to the opposite end, a preferred location being in approximate alignment with the forward legs 23*b*, 25*b* of end stand. In this position, the scissors array 51 extneds in a forwardly tilted or inclined position relative to a vertical axis, i.e., perpendicular to the plane of base frame 11, being free to assume such inclination due to the pivotal connection of its base end to plate 63. The upper end of scissors array 51, on the other hand, is pivotally connected on pivot axis 73 to the lower end of a connection link 75 pivoted at its upper end to lifter bar 43, link 75 being preferably formed as two transversely spaced parallel links for greater strength and rigidity. Thus, scissors array 51 and connecting link 75 together constitute an expandable toggle linkage having its lower end pivotally fixed on base frame 11. Generally, in fully depressed position of the jack, the pivot axis 73 is on the front side of lifter bar 48 nearer the free ends of lift arms 31, 33, as shown in dotted lines in FIG. 3 (although the solid line position is in alternative starting position), and during the upward rocking movement of the lifter arms, axis 73 swings clockwise in FIG. 3 around bar 43 as the scissors 51 expands until the toggle linkage approaches dead center when the lifter arms reach their highest point of travel at about a "two o'clock" position. In order to limit the freedom of scissors array 51 to pivot relative to the base frame, particularly in a frontward direction, i.e., toward the free ends of the lifter arms, the upwardly extending side of angle beam 69 serves as a front abutment for the lower end of the scissors array and thereby prevents further frontward swinging of the scissors array during its initial expansion and until it is positively rocked to a more vertical inclination as a consequence of its upper end following the arc of pivotation of lifter bar 39. In the embodiment illustrated, separation of the scissors array from angle beam 69*b* can occur at approximately the point at which lifter arms reach a generally horizontal position, i.e., parallel to the plane of base frame 11.

Figure 3:
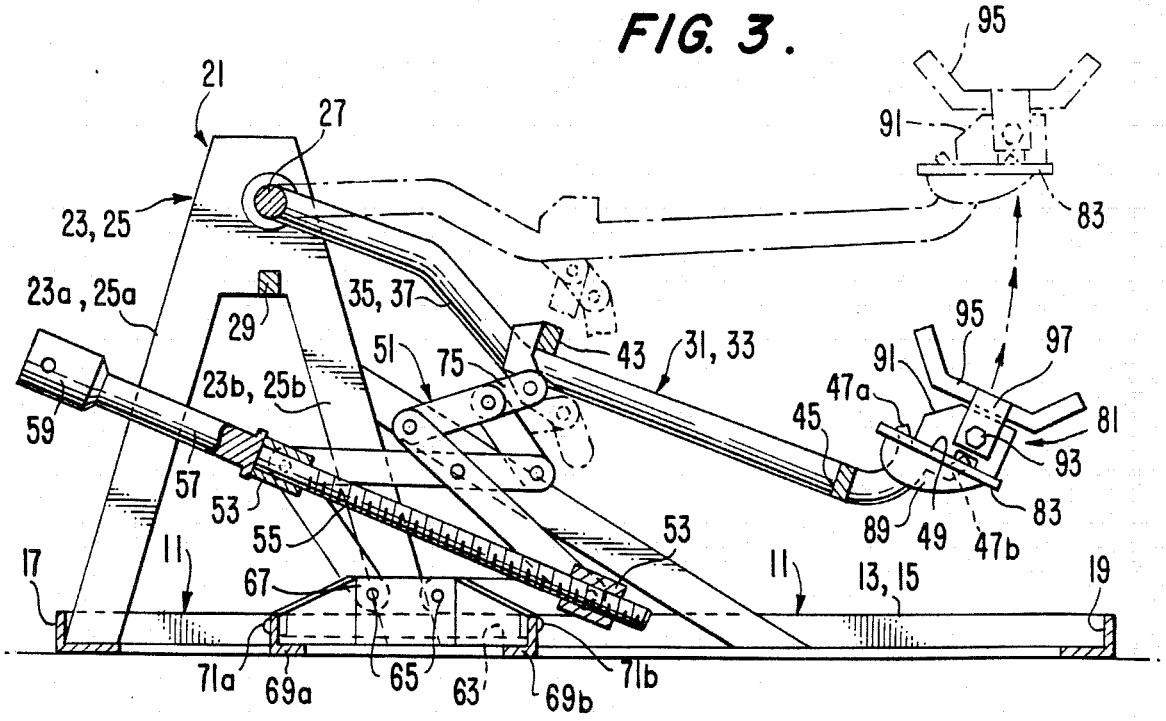
FIG. 3 is a vertical section taken substantially along line 3—3 of FIG. 2 showing the lifter arm and adapter thereon in starting position in solid lines, an alternative operative starting position in dotted lines, and in partial lifted position in dot-dash lines.

If the expansion range of the scissors array 51 is sufficiently large, it becomes possible for the toggle linkage formed of the scissors array 51 and connecting link 75 starting from the dotted position in FIG. 3, to move through dead center which results in connecting link 75 swinging clockwise to the opposite, i.e., rearward, side of lifter bar 39 toward stand 21, as suggested in dot-dash lines in FIG. 3, with consequential rearward rocking of the scissors array. This result does not affect the operation of the overall jack assembly of the invention or cause any significant change in the position of the lifter arms or of the load, i.e., the chassis member, supported thereby, but it does have the advantage of providing a tolerance for accidental operation of the invention beyond its normal effective range. If the expandable toggle linkage should pass through dead center, as just described, when the jack is eventually operated to lower the lifter arms, the scissors array 51 merely retracts until the point is reached at which the toggle linkage tends to swing back through dead center and into its (dotted line) starting position. However, pivot axis 73 can remain on the back side of bar 43, as seen in solid lines, under some circumstances, e.g., when held there by the weight of the load.

Tractors and similar vehicles of the type in question come equipped with a variety of different types of chassis members. The front end or axle can be an I-beam, an H-beam, or a U-shaped or C-shaped channel, each of possible varying thickness, while the rear chassis member will usually be of tubular or cylindrical configuration since the rear wheels are almost always the drivers of the tractor and receive power through drive shafts housed within the same. It is difficult to construct the ends of the lifter arms of the jack so as to accommodate all of the different types of chassis members that may be encountered, and the jack of the invention is, therefore, desirably equipped with an adapter for the free ends of the lifter arms which are capable of engaging with other types of chassis members and thus broaden the flexibility for using the jack. A particularly preferred type of adapter is shown in the drawings, only one of which will be described although it will be understood that the end of each lifter arm will, of course, be similarly equipped. In the drawings, the adapter is generally designated 81 and includes a flat platform 83 adapted to seat on its underside against the supporting surface 49 at the free end of each lifter arm and having therein longitudinally spaced apart apertures 85 *a, b* (FIG. 5) for penetration thereby of the fingers 47*a, b* of the bifurcation of the lifter arm end. Platform 83 can be stabilized against lateral shifting movement on the arm by means of ears 89 projecting downwardly from platform 83 in stradling relation to the opposite sides of the end of the arm. Platform 83 supports on its top an upstanding tongue 91 to which is pivoted by means of pivot pin 93 an upwardly opening cradle 95 in the shape, for example, of a flat U. Preferably, cradle 95 is free to rock generally rearwardly about pin 93, riding on downwardly projecting pivot ears 97 which support pin 93 so that the cradle can assume a generally horizontal position when the lifter arms are in fully lowered position and can remain horizontal with chassis member (indicated at C in FIG. 4) thereon during much of the lift range of the jack and, to this end, the rearward corner of tongue 91 is removed as at 99. Similar forward tilting movement of cradle 95 should be prevented to reduce the risk of the chassis member accidentally slipping off the cradle which can be achieved by the natural abutment of the cradle against the forward corner of tongue 91 or, if preferable, by stop lugs, not shown, provided on that tongue.

Ideally, to minimize any possibility of detachment while under load of the adapter from the end of the lifter arm to which it is fitted, the downward load of the tractor is used to create positive anchoring of the adapter in place on the end of the lifter arm. This is achieved by inclining at least one of the bifurcation fingers of the lifter arm away from perpendicular to the lengthwise axis of the arm as at 101 for wedging engagement in the manner of a cam surface with an edge of the corresponding one of the adapter platform apertures 85*a*. In addition, a detent shoulder 103 is provided on one of the lifter arm fingers at a point spaced from the inclined surface 101 for abutment with a cooperating detent edge 105 on the adapter platform. Conveniently, the same bifurcation finger 47*a* can carry both the inclined wedging surface 101 and detent surface 103, as shown in the illustrated embodiment especially FIG. 6, but this function can be divided between the fingers if desired, or the detent shoulder and wedging surface can be otherwise constructed on the adapter. In any case, the arrangement is such that the adapter is situated on the end of the lifter arm by a rocking motion (clockwise in FIGS. 3 and 4) to anchor the edge of aperture 85*a* against the inclined wedging surface 101 of the tongue 47*a* and after the adapter is so anchored, it is restrained against backward shifting movement by the detent shoulder-to-surface abutment. The center axis of the adapter along which the load is applied is located at a point spaced forwardly from the site of the tongue wedging surface so that the center axis of the load is displaced from that site and thus the weight of the load acts to magnify the wedging or camming action anchoring the adapter platform in operative position. As shown, it is preferred that the rear tongue 47*a* carry the inclined wedging surface 101 with the adapter axis passing through pivot axis 93 located somewhat forwardly thereof, but these relative positions could be reversed if desired.

The bifurcated tongues 47*a, b* carried directly by lifter arms are specially suited for engagement with an I-beam or narrow H-beam type channel member and the cradle type adapter is especially appropriate for wider channel shaped chassis members or a round driving tube at the rear of the tractor. Of course, the configurations of the lifter arm end and/or adapter can be modified as needed to accommodate the designs of tractors and like vehicles which are on the market at a given time.

Although the scissors array and its associated screw actuating components will normally possess sufficient constructional strength to adequately withstand the load of the tractor after the same has been elevated, another desirable feature of the invention can be a positive latching mechanism to receive this load directly from the lifter arms and thus relieve the stress upon the scissors array with consequential increased safety while working underneath the elevated vehicle. To this end, fulcrum bar 27 is journaled for pivotation in end stand 21 and a ratchet gear 111 is fixed on bar 27 for rocking movement therewith at a point along the length thereof proximate to one of the end stand sides 23, 25, such as the right side 25 as seen in the drawings. A cooperating pawl 113 is pivoted in a pivot bracket 114 on one leg of the corresponding end stand side for rocking movement between an operative latching position engaged with the teeth of ratchet gear 111 to prevent rotation thereof in a downwardly rocking, i.e., clockwise direction while permitting rotation in an upwardly rocking, i.e., counterclockwise, direction, and an inoperative disengaged position permitting rocking in both directions. Pawl 113 is normally biased into operative latching position by means of a compression spring 115 and to facilitate release of the pawl from latching position from the same side of the jack assembly as the screw rotating handle 61, an elongated release rod 117 passes generally horizontally through legs 25*a, b* of the end stand side, being connected at its inner end 119 to the lower end of pawl 113 and having its opposite end bent into a ring or crook 121 for each grasp by the operator. Thus, as will be obvious from FIG. 4 in particular, when the ring 121 of rod 117 is grasped and pulled outwardly or to the left as seen in FIG. 4, pawl 115 will be released from ratchet gear 111 allowing retraction of the lifter arm. For some occasions, disengagement of the latching action of pawl 113 is advantageous and for this purpose a disengaging pin 123 can be inserted in an opening formed therefor in pivot bracket 114 to hold the pawl out of engagement with ratchet 111.

Some variations in the construction of the jack of the invention have already been indicated during the course of the above description, and others will certainly be readily apparent to the skilled worker in the art from a reading of this description. It is, therefore, intended that all such modifications will be encompassed within the scope of the present invention except when excluded by the language of the appended claims.

What is claimed is:

1. A portable jack for small tractors, riding lawn mowers, and the like vehicles having at least one chassis member, which jack comprises a base frome having a length generally greater than its width; an end stand mounted on said base frame adjacent one end thereof and including upstanding transversely spaced apart sides, each having two legs which are longitudinally spaced apart at the base frame, and means extending transversely between said sides to maintain said sides apart including a fulcrum bar adjacent the top of said sides; a pair of transversely spaced apart lifter arms connected to one end of said fulcrum bar for pivotal movement about the bar axis and extending longitudinally in generally parallel relation toward but stopping short of the opposite end of said base frame, with their free ends adapted to engage said chassis member, said lifter arms being braced apart by at least one transverse bracing bar located nearer their pivoted ends than their free ends; and means for applying lifting force via said bracing bar to said lifter arms including a screw actuat-d scissors jack having its base seated on said base frame generally between said end stand sides for limited rocking movement about a transverse axis and extending generally upwardly from said base frame, and a connecting link pivoted at one end to the upper end of said scissors jack and at the other to said bracing bar to form with said scissors jack an expandable toggle linkage between said bracing bar and said base frame which is operable to pivot said lifter arms about said fulcrum bar and elevate said vehicle chassis member engaged thereby.

2. A jack as in claim 1, wherein the legs of each of the sides of said end stand are arranged generally in the shape of a triangle and said fulcrum bar is disposed adjacent the upper ends of said triangles.

3. A jack as in claim 1, wherein said fulcrum bar is journaled at opposite ends in said end stand sides and said lifter arms are integrally connected at their pivoted ends to said fulcrum bar for pivotal movement therewith.

4. A jack as in claim 1, wherein said base frame includes at least one transverse beam extending intermediate the frame ends and having an upstanding flange thereon adjacent the base of the scissors jack on the side nearer the free ends of said lifter arms to contact the adjacent lower end of said scissors jack and thereby limit its rocking movement toward the free ends of said lifter arms and thus support said scissors jack during its actuation to elevate said lifter arms.

5. A jack as in claim 3, wherein a ratchet gear is affixed to said journaled fulcrum bar for rotation therewith and a cooperating pawl is rockably mounted on one of said end stand sides for engagement with said ratchet gear to lock said fulcrum bar and lifter arms after their elevation against downward pivotal movement.

6. A jack as in claim 5, including biasing means urging said pawl into engagement with said ratchet gear and releasing means operative for releasing said pawl from engagement with said ratchet gear against the bias of said biasing means.

7. A jack as in claim 1, wherein each of said lifter arms includes a generally downwardly directed dogleg shaped section adjacent the pivoted end thereof so as to facilitate placement of said lifter arms beneath the chassis member of said vehicle.

8. A jack as in claim 1, wherein the longitudinal dimension of said base frame exceeds the length of said lifter arms so as to restrain said jack from tilting when lifting the chassis member of said vehicle.

9. A jack as in claim 4, including a jack foot plate removably disposed on said base frame and means for pivotally connecting the base of said scissors jack to said foot plate for said limited rocking movement relative thereto.

10. The jack of claim 1, wherein the free end of each lifter arm is longitudinally bifurcated.

11. The jack of claim 1, wherein the free end of each lifter arm has at its extremity a generally uwardly facing supporting surface and at least one rigid tongue projecting upwardly from one end of said surface with at least the side of said tongue remote from said surface being inclined upwardly away from the surface, and including an adapter for the free end of each lifter arm to adapt the same to engage different configurations of chassis members, which adapter comprises a platform abutting on said supporting surface and at least one aperture passing through said platform for penetration by said tongue and having an edge thereon engaging said inclined side of said tongue, and an upwardly opening cradle carried by said platform for engaging said chassis member with the cradle axis on the opposite side of said aperture from the inclined tongue surface, whereby the application of a load during operation to said adapter causes the aperture in the adapter platform to wedge against said inclined tongue surface to hold the adapter in place.

12. The jack of claim 11, including cooperating detent surfaces on said adapter and said lifter arm end for preventing relative sliding movement of said platform and supporting surface while the two are in abutment with said tongue penetrating said platform aperture.

13. The apparatus of claim 12, wherein said adapter supporting surface on said arm end includes a generally upstanding shoulder thereon spaced longitudinally from the inclined side of said tongue and said adapter has a cooperating detent edge adapted for longitudinal abutment with said shoulder to thus provide an edge-to-shoulder abutment when the adapter is in abutment with said supporting surface with said tongue in said aperture, said edge-to-shoulder abutment preventing the removal of the adapter against the wedging action of said aperture edge against said inclined tongue surface except by an upward tilting movement opposite to the weight of the load applied to said adapter.

14. The jack of claim 11, including lateral stabilizing ears projecting downwardly from said adapter platform on either side of the end of said lifter arm.

15. The jack of claim 11, wherein each said adapter cradle is of generally flat U-shape.

16. The jack of claim 14, wherein said cradle is pivoted to said platform for limited rocking movement about a horizontal axis.

17. The jack of claim 15, including stop means to prevent said cradle from tilting relative to said lifter arm in a direction away from said end stand while permitting the same to tilt in the opposite direction and remain generally vertical during operation.

18. The jack of claim 13, wherein said upstanding shoulder of said edge-to-shoulder abutment is formed on the side of said tongue opposite the inclined surface thereon and said detent edge is formed on an edge of said aperture opposite to the edge thereof in contact with said inclined tongue surface.

* * * * *